US008667950B1

(12) United States Patent
Fillios, Sr.

(10) Patent No.: US 8,667,950 B1
(45) Date of Patent: Mar. 11, 2014

(54) OIL-LESS ROTARY ENGINE

(71) Applicant: Thomas Lee Fillios, Sr., E. Boston, MA (US)

(72) Inventor: Thomas Lee Fillios, Sr., E. Boston, MA (US)

(73) Assignee: Thomas Lee Fillios, Sr., Merrimack, OH (US)

( * ) Notice: Subject to any disclaimer, the term of this patent is extended or adjusted under 35 U.S.C. 154(b) by 0 days.

(21) Appl. No.: 13/764,229

(22) Filed: Feb. 11, 2013

(51) Int. Cl.

| | |
|---|---|
| ***F02B 53/04*** | (2006.01) |
| ***F01C 1/02*** | (2006.01) |
| ***F04C 2/00*** | (2006.01) |
| ***F04C 18/00*** | (2006.01) |

(52) U.S. Cl.
USPC ..... 123/229; 123/228; 418/61.2; 418/61.1; 418/60

(58) Field of Classification Search
USPC ..... 123/226–229, 204, 241, 242, 249, 213, 123/220, 217, 231, 234; 418/61.2, 61.1, 418/61.3, 60, 5, 9
See application file for complete search history.

(56) References Cited

U.S. PATENT DOCUMENTS

| | | | | | |
|---|---|---|---|---|---|
| 1,955,461 | A | * | 4/1934 | Hickerson et al. | 123/226 |
| 3,234,921 | A | * | 2/1966 | Laing et al. | 418/61.2 |
| 3,234,922 | A | * | 2/1966 | Froede | 418/61.2 |
| 3,250,260 | A | * | 5/1966 | Heydrich | 123/213 |
| 3,259,115 | A | * | 7/1966 | Bensinger et al. | 418/61.2 |
| 3,288,121 | A | * | 11/1966 | Linder | 418/61.3 |
| 3,364,907 | A | * | 1/1968 | Jeanson | 418/61.3 |
| 3,424,135 | A | * | 1/1969 | Tado | 418/61.2 |
| 3,450,107 | A | * | 6/1969 | Broel-Plater et al. | 418/60 |
| 3,513,814 | A | * | 5/1970 | Jones | 418/61.2 |
| 3,561,894 | A | * | 2/1971 | King | 418/61.2 |
| 3,588,296 | A | * | 6/1971 | Toyama et al. | 418/61.2 |
| 3,760,777 | A | * | 9/1973 | Leroy et al. | 418/61.1 |
| 3,782,340 | A | * | 1/1974 | Nam | 123/204 |
| 3,867,910 | A | * | 2/1975 | Galonska | 123/208 |
| 3,883,273 | A | * | 5/1975 | King | 418/61.2 |
| 3,903,847 | A | * | 9/1975 | Olenzek et al. | 418/60 |
| 3,922,120 | A | * | 11/1975 | McCullough et al. | 418/5 |
| 3,942,917 | A | * | 3/1976 | Wieland | 418/60 |
| 3,957,021 | A | * | 5/1976 | Loyd, Jr. | 123/209 |
| 4,132,513 | A | * | 1/1979 | Kulina | 418/61.2 |
| 4,274,374 | A | * | 6/1981 | Lee | 123/241 |
| 4,688,531 | A | * | 8/1987 | Aase | 123/227 |
| 5,127,377 | A | * | 7/1992 | Yang | 123/242 |
| 5,154,149 | A | * | 10/1992 | Turner | 123/249 |
| 5,199,391 | A | * | 4/1993 | Kovalenko | 123/43 B |
| 5,571,244 | A | * | 11/1996 | Andres | 123/231 |
| 6,606,973 | B2 | * | 8/2003 | Moe | 123/228 |
| 7,264,452 | B2 | * | 9/2007 | Sbarounis | 418/54 |
| 8,037,862 | B1 | * | 10/2011 | Jacobs | 123/242 |
| 8,365,699 | B2 | * | 2/2013 | Shkolnik et al. | 123/222 |

(Continued)

FOREIGN PATENT DOCUMENTS

| | | | | |
|---|---|---|---|---|
| DE | 2500530 | A1 * | 5/1976 | F01C 1/34 |

*Primary Examiner* — Thai Ba Trieu

(57) ABSTRACT

Method and apparatus for oil-less engine with a revolving rotor are shown. Oil-less engine allows manufacturers to build environmentally safer oil-free engines, with fewer engine parts and at reduced costs of manufacturing. In one embodiment, the present invention is a method of internal combustion in an oil-less engine casing. The method is, revolving a multi-angular rotor around a center point to sequentially combust with each of a plurality of fireheads, revolving in a manner that each side of the multi-angular rotor successively achieves a top dead center position with a respective firehead. A firehead is a combination of a sparking means, a fuel injector and an air injector.

1 Claim, 13 Drawing Sheets

(56) References Cited

U.S. PATENT DOCUMENTS

2006/0140808 A1* 6/2006 Sbarounis ..... 418/61.2
2009/0133664 A1* 5/2009 Reid ..... 123/200
2011/0271830 A1* 11/2011 Sole ..... 92/120

* cited by examiner

OIL-LESS ROTARY ENGINE

This present application is based on the provisional U.S. patent application No. 61/796,983, filed on Aug. 8, 2012 which is here with incorporated by reference.

FIELD

Embodiments of the present invention relate generally to engines and motors. More specifically, embodiments of the invention relate to internal combustion of oil-less engines.

BACKGROUND

Prior art engines often utilize engine oil for lubricating pistons and cylinders. Engine oil produces pollutants, causing pollution to environment. Prior art engines also comprise numerous moving or wearable parts. Such parts include, but are not limited to, pistons, cylinders, nuts and bolts, pushrods, valves, lifters, cylinder walls, piston pins, rod bearings, rockers, rocker posts, springs, chains, sprockets, sprocket covers, and piston rings. These parts contribute to the issues of increased size and weight, lower reliability and higher costs of manufacturing. Given the aforementioned issues, prior art engines have insufficient environmental safety, reliability and economics in manufacturing.

SUMMARY

The present invention improves environmental safety standards of internal combustion engines by eliminating the use of engine oil in the internal combustion area of an engine, thus reducing pollutants and increasing environmental safety. The invention reduces the number of engine parts of prior art engines, thereby minimizing engine weight and lowering the costs of production. The present invention also increases reliability and efficiency of an engine by reducing the number of wearable engine parts that include, but are not limited to, camshafts, valves, lifters, rod bearings, rockers, springs, and sprockets. Notably, the present invention also eliminates the use of pistons and cylinders.

In one aspect, the present invention comprises an engine casing with a front cover and a rear cover; a plurality of fireheads circumferentially positioned on the inside wall of said casing; a multi-angular rotor positioned centrally in said casing wherein said rotor is capable of revolving around a center point, and, at least one side of said rotor faces a firehead selected from said plurality of fireheads. The invention further comprises a means for circularly guiding said rotor to a top-dead-center position of a firehead selected from said plurality of fireheads, wherein each side of said rotor at revolution achieves a top-dead-center position with a respective firehead for a combustion; and a means for transferring rotational energy generated by said rotor to a transmission. A firehead comprises a sparking means, a fuel injector and an air injector. A firehead is a combustion area inside an engine where a mixture of fuel and air is compressed and then ignited.

In another aspect, the present invention is a method of internal combustion in an oil-less engine casing, the method comprising, revolving a multi-angular rotor around a center point to sequentially combust with each of a plurality of fireheads, wherein each side of said rotor successively achieves a top dead center position with a respective firehead.

Other aspects of the invention will be apparent from the detailed description below.

BRIEF DESCRIPTION OF THE DRAWINGS

The embodiments of the present invention described herein are exemplary, and not restrictive.

DETAILED DESCRIPTION

Figure 1:
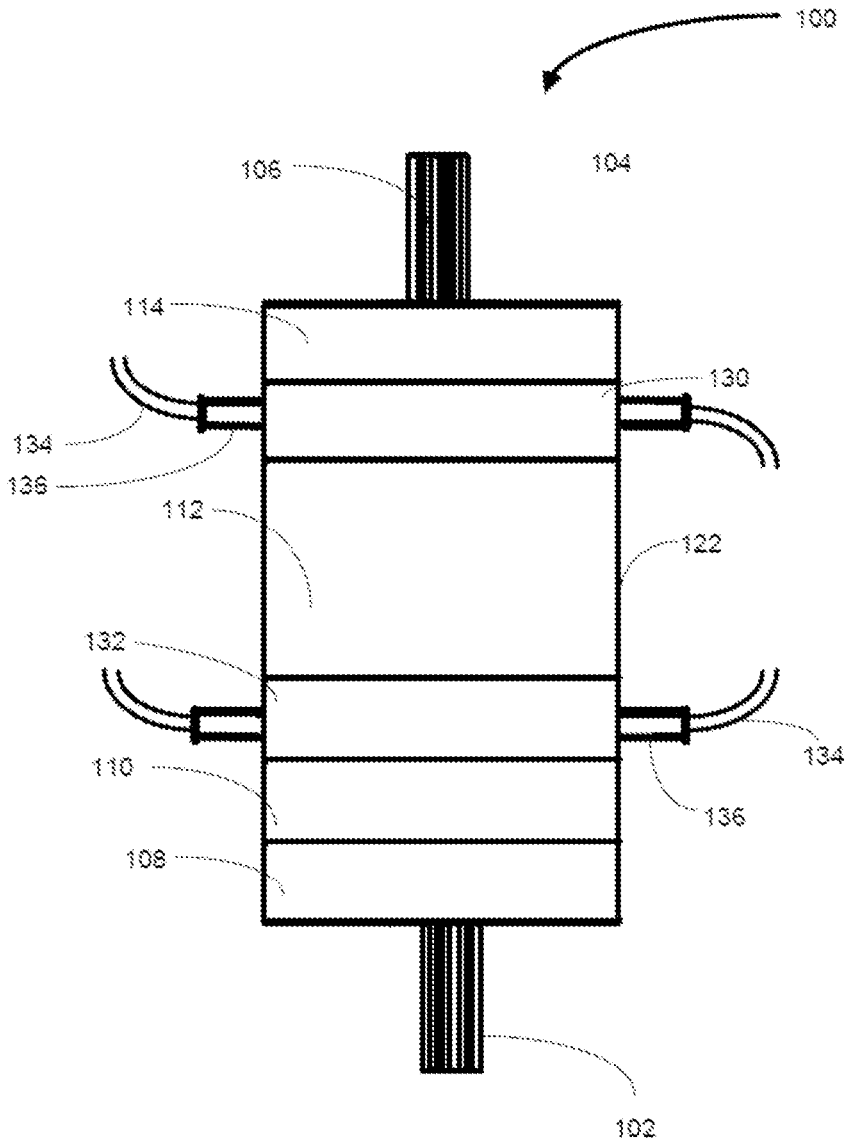
FIG. 1 is an embodiment identifying engine sections of an engine of the present invention.

In the following description, for purposes of explanation, numerous specific details are set forth in order to provide a thorough understanding of the invention. It will be apparent, however, to one skilled in the art that the invention can be practiced without these specific details.

Broadly, embodiments of the present invention present an oil-less engine comprising an engine casing with a multi-angular rotor, in which each side of the rotor revolves to meet a top dead center position with a respective firehead. The firehead combusts (ignites with a mixture of fuel and air), and creates a pressure of the expanding combustion fuel to turn the rotor, thereby, creating mechanical energy. For the purpose of this invention, we define "firehead" as a combustion area inside an engine where a mixture of fuel and air is compressed and then ignited. A "firehead" can also be called a combustion chamber. A firehead comprises a sparking means, an air injector, and a fuel injector. A sparking means may comprise a spark plug.

In one embodiment, the present invention comprises an engine casing with a front cover and a rear cover; a plurality of fireheads circumferentially positioned on the inside wall of said casing; a multi-angular rotor positioned centrally in said casing wherein said rotor is capable of revolving around a center point, and, at least one side of said rotor faces a firehead selected from said plurality of fireheads. The invention further comprises a means for circularly guiding said rotor to a top-dead-center position of a firehead selected from said plurality of fireheads, wherein each side of said rotor at revolution achieves a top-dead-center position with a respective firehead for a combustion; and a means for transferring rotational energy generated by said rotor to a transmission.

In another embodiment, the present invention is a method of internal combustion in an oil-less engine casing, the method comprising, revolving a multi-angular rotor around a center point to sequentially combust with each of a plurality of fireheads, wherein each side of said rotor successively achieves a top dead center position with a respective firehead.

Advantageously, the present invention improves environmental safety of internal combustion engine by eliminating the use of engine oil from the internal combustion area of an engine, thus reducing pollutants. Further, the invention reduces the number of engine parts of prior art engines, thereby minimizing engine weight and lowering the costs of production. The present invention also increases reliability and efficiency of an engine by reducing the number of wearable engine parts that include, but are not limited to, camshafts, valves, lifters, rod bearings, rockers, springs, and sprockets. The present invention also eliminates the use of cylinders and pistons.

Technical know-how, functionalities and operation of prior art engines are known to a person of ordinary skill in the art of engine making. The description herein focuses on novelty in a manner that the solution concept of the present invention is discernable from prior art engines. Embodiments covering dimensions and engineering specifications of the present invention are not restrictive, meaning inclusive, to the present invention. Dimensions and engineering specifications are known to a person of ordinary skilled in the art. Dimensions and specification are customizable.

For the purpose of the present invention, the term "oil-less" is used to describe an engine that does not use engine oil for lubrication in its internal combustion area. However, oil or lubricating agents may be used outside of internal combustion area for lubricating mechanical assembly, such as, crankshafts and bearings.

With reference to FIG. 1 to FIG. 13, embodiments of an engine of the present invention are described below. The phrase "an embodiment" refers to an embodiment of an engine of the present invention.

FIG. 1 is an embodiment 100 identifying the engine sections of an oil-less engine of the present invention. The engine casing 122 comprises a crankshaft in each end, a front crankshaft half 106 and a rear crankshaft half 102. The crankshaft halves (102 and 106) are splined. The splined spout of the rear crankshaft half 102 transfers energy from the engine to a transmission. The engine comprises a front cover "front hatch" 114 and a rear cover "rear hatch" 108. The exhaust eliminator 110 is located in the rear side of the engine. From the internal combustion area 112, energy is transferred out through the crankshaft halves, the front crankshaft half 106 and the rear crankshaft half 102. The front crankshaft half 106 transfers energy to pulley or belt systems. The embodiment 100 comprises two adjustable bearing modules, 130 and 132. The adjustable bearing modules 130 and 132 hold crankshaft halves in places. Each adjustable bearing module has an inlet and an outlet for oil to pass through. An inlet comprises an oil tubing 134 and an oil fitting 136. An outlet comprises an identical oil tubing and an identical oil fitting.

Figure 2:
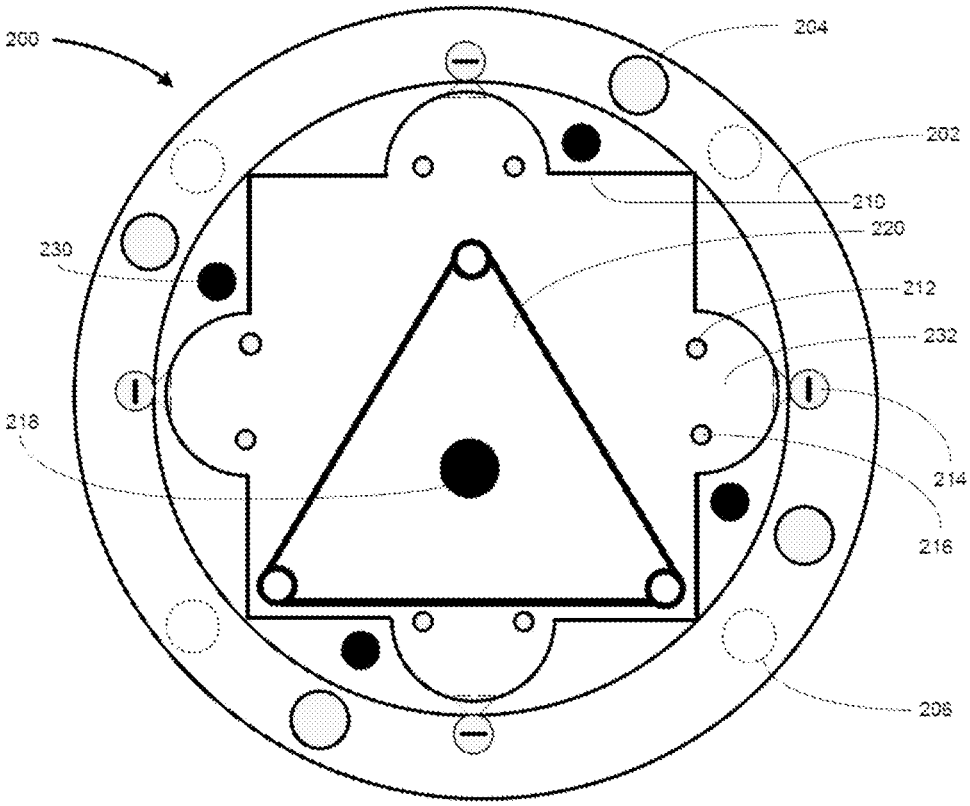
FIG. 2 is an embodiment of the engine of FIG. 1 showing the internal combustion area of the engine of the present invention, an engine casing, a plurality of fireheads, and a rotor.

FIG. 2 is an embodiment 200 showing the internal combustion area of an engine of the present invention. The engine comprises an engine casing 202. In the engine casing 202, there is a plurality of coolant holes, such as, coolant hole 204. In the engine casing 202, there is a plurality of air conditioning (AC module) holes, such as, AC hole 206.

A plurality of fireheads, such as 232, are circumferentially located at the inner edge of the engine casing 202. Each firehead comprises a fuel injector 212, a sparking means 214 and an air injector 216. There is a rotor 220 that rotates in an axis 218. Revolution of the rotor is guided by a means of guide 210 ("rotor guide"). The rotor guide 210 is a wall that surrounds the rotor 220, so that the rotor 220 can rotate or glide within the perimeter of the wall.

The rotor 220 revolves in a way to position a side of the rotor to a top dead center position with one of the fireheads. The rotor guide 210 will cause a side of the rotor 220 to arrive at a top dead center position with a firehead for a combustion. A top dead center position is an optimal position at which a combustion occurs between the rotor 220 and a firehead. A flat surface of the rotor and a firehead align with each other to achieve a top dead center position. In the embodiment 200 as shown by FIG. 2, there are four top dead center positions, one at each firehead. The number of top dead center positions depends on the number of fireheads. The embodiment 200 has 3 sides of the rotor 220 (a triangular cube) and 4 fireheads. The triangular cube shaped rotor 220 has 3 slopes and 2 flat surfaces. Each of the 3 slopes, at the rotor's revolution in an offset axis, aligns with a firehead to achieve a top dead center position. The 2 flat surfaces are connected with crankshaft halves.

A plurality of coolant holes, such as coolant hole 204, hold engine coolant to cool down the engine of the present invention. A combustion at a firehead generates force (pressure) and rotates the rotor, thus creating rotational (mechanical) energy. Rotational energy or power is transferred to the crankshaft halves (102 and 106) that are connected to the rotor 220. The crankshaft halves transfer energy out from the engine to a transmission and to a pulley/belt system. The embodiment 200 comprises a plurality of dimples, such as, 230, that may be used to screw-on the module of embodiment 200 to an engine casing. Alternatively, the parts of the engine of the present invention, wherever seen appropriate by a person of ordinary skill in the art, may be either screwed-on to an engine casing in a modular fashion or casted in a single mold.

Figure 3:
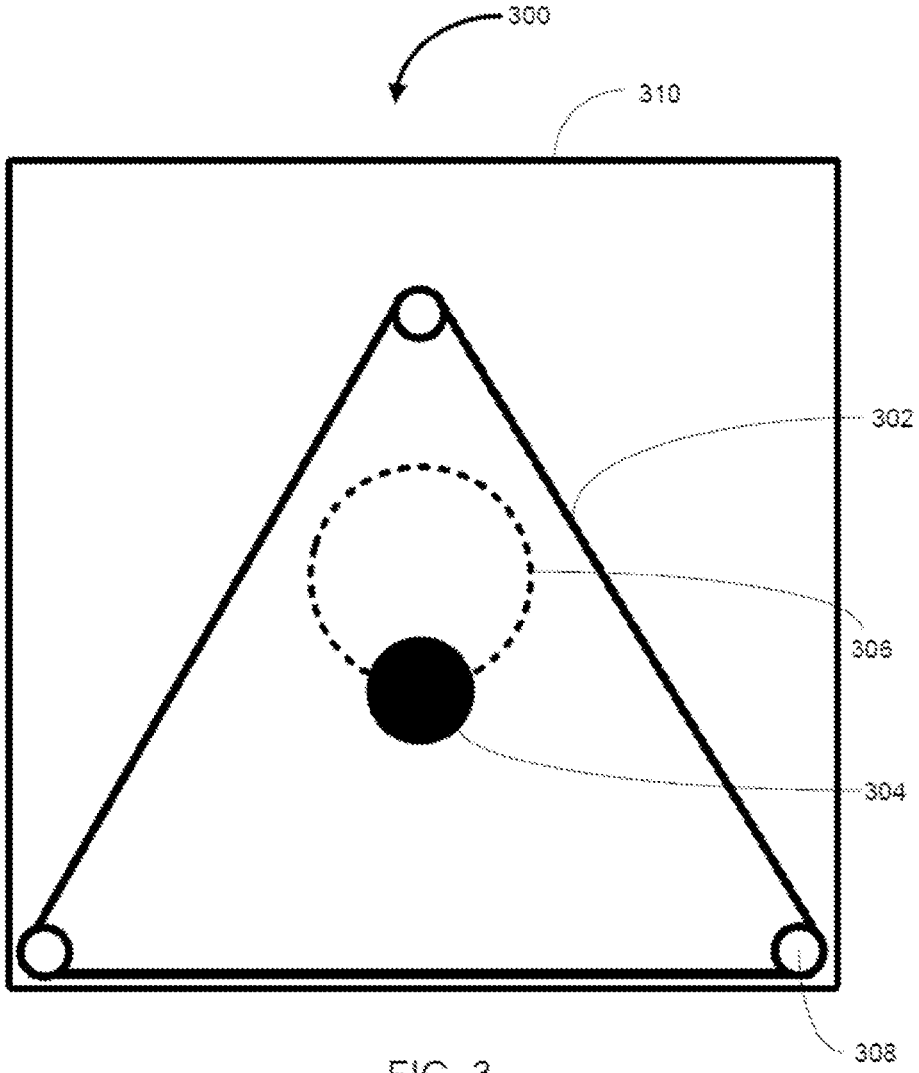
FIG. 3 is an embodiment of the engine of FIG. 1 showing a rotor and its offset axis of rotation.

FIG. 3 is an embodiment 300 showing a multi-angular rotor 302 and a means ("rotor guide") 310 for circularly guiding the rotor 302. The exemplary multi-angular rotor 302 is a triangular cube with 5 sides, in which 3 sides (triangular slopes) are combustion surfaces and remaining 2 flat sides connect to crankshaft halves. The embodiment 300 represents a rotor 302 that has an offset axis of rotation 306. Two crankshaft halves (front and rear) are assembled at 304, each crankshaft half facing the opposite side of the 2 flat sides (surfaces) of the rotor. When the rotor 302 rotates within the means of guide 310, the axis of rotation changes, thereby creating an offset axis 306. Each angle in a rotor may comprise a rotor insert 308. The rotor insert 308 may facilitate an easy glide of the rotor within the rotor guide 310 and reduce friction with the rotor guide. Rotor inserts may be fabricated using a material seen appropriate by a person of ordinary skill in the art, which may include but are not limited to, plastic, rubber or silicon.

Figure 4:
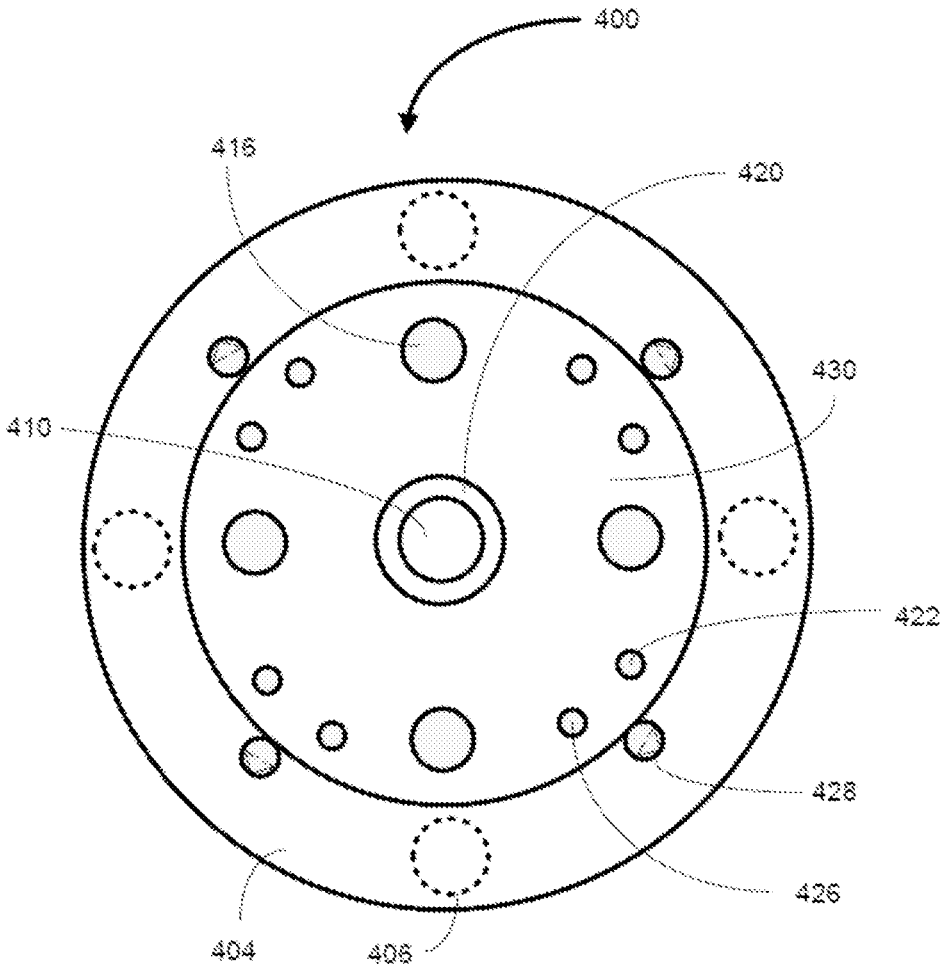
FIG. 4 is an embodiment of the engine of FIG. 1 showing a front cover of the engine, also called a "front hatch."

FIG. 4 is an embodiment 400 showing a front cover 430 of an engine of the present invention ("front hatch" 430) that is screwed onto an engine casing 404 using dimples, such as, 416. A dimple is an area of depression on which a screwing tool may be applied for screwing. The front hatch 430 is an ingress to get to the inside of the engine of the embodiment 200. In the engine casing 404, there are a plurality of holes that carry air conditioning (AC) modules, such as, AC hole 406. AC modules may be used to cool down the engine casing. An AC module is described in an embodiment 1300. The space 420 provides a room for a crankshaft half 410 to pass through. There are a plurality of dimples, such as dimple 416, to unscrew the front hatch from the engine casing 404. The front hatch provides a screw-on space for a fuel injector 422 and an air injector 426. A sparking means may be screwed on to the engine casing at 428. Depending on the number of fireheads, for each firehead, a fuel injector 422, a sparking means 428 and an air injector 426 are needed to carry out a combustion (ignition of fuel and air mixture to create a pressure or force from the gas that is produced after the mixture is ignited).

Figure 5:
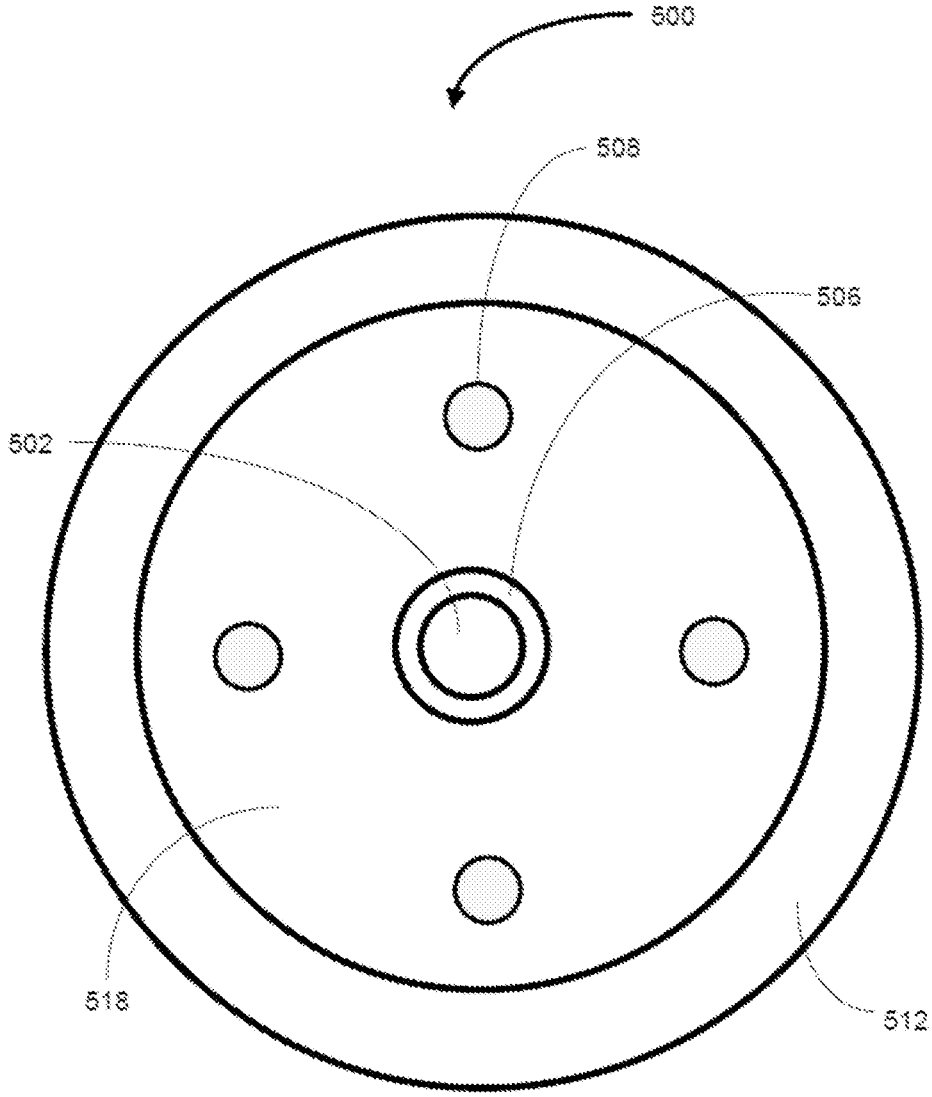
FIG. 5 is an embodiment of the engine of FIG. 1 showing a rear cover of the engine, also called a "rear hatch."

FIG. 5 is an embodiment 500 showing a rear cover "rear hatch" 518 of an engine casing 512. The rear hatch 518 is screwed on to the engine casing 512. The rear hatch 518 provides a space 506 for a crankshaft half 502 to pass through. The rear hatch 518 comprises a plurality of dimples, such as, dimple 508, for screwing the hatch 518 to the engine casing 512.

Embodiments of the present invention are shown using an screw-on assembly of modular engine parts. However, a person of ordinary skill in the art knows that alternative means of attachment, such as, nuts and blots, may be used to achieve identical functionalities of the present invention. In another embodiment, two or more engine parts of the present invention may be casted in a single mold, thus avoiding a screw-on assembly or nut and bolt assembly.

Figure 6:
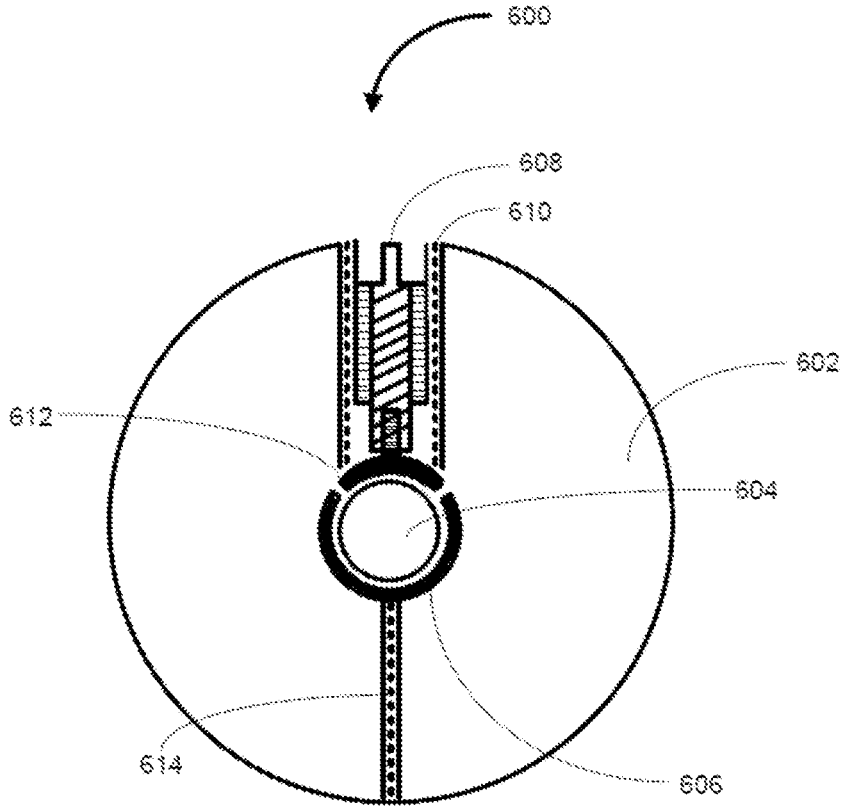
FIG. 6 is an embodiment of the engine of FIG. 1 showing an adjustable bearing module.

FIG. 6 is an embodiment 600 of an adjustable bearing module 602 that is screwed on to an engine of the present invention. A placement of a front adjustable bearing module is shown at 130 in FIG. 1. A placement of a rear adjustable bearing module is shown at 132 in FIG. 1. An adjustable bearing module holds and tightens a crankshaft half 604 in place. An upper bearing 612 and a lower bearing 606 can be squeezed to a desirable poundage (force per square inch) by rotating a lever 608. An adjusted bearing (a combination of 612 and 606) squeezes and securely holds a crankshaft half 604 in place. A lubricating agent or oil can pass to the bearing through an inlet passage 610. Oil is used to reduce friction between the bearing and the crankshaft half, and between other relevant parts. Excess oil is removed by an outlet passage 614. The upper bearing 612 and the lower bearing 606 are accommodated for oil to drip in and drip out. Oil is used to reduce friction and heat from mechanical assembly or joints.

The oil from the two adjustable bearing modules (positioned at 130 and 132) does not reach the internal combustion area of the present invention. The use of oil in the adjustable bearing modules does not conflict with the inventive concept of the present invention that is described as oil-less.

Figure 7:
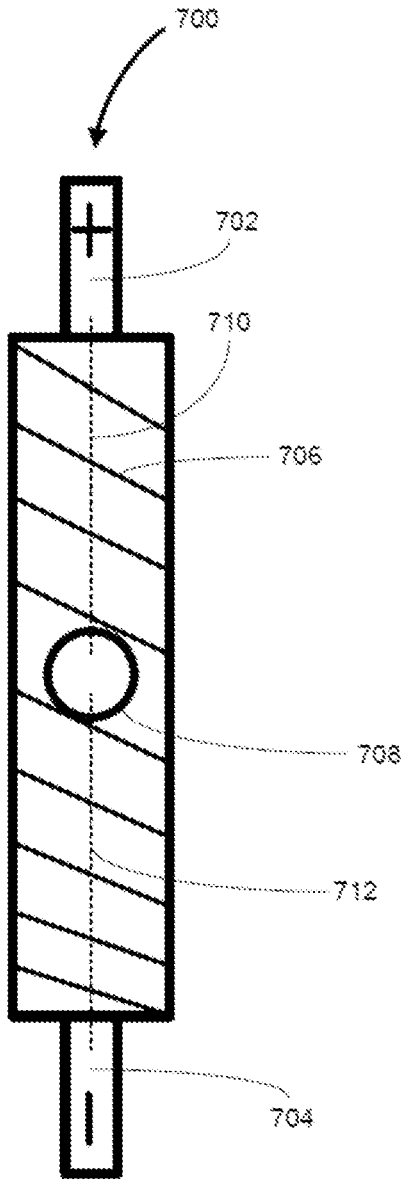
FIG. 7 is an embodiment of the engine of FIG. 1 showing an insulated spark rod.

FIG. 7 is an embodiment 700 of a spark rod that is used as a part of sparking means. A spark rod 706 has a positive end 702 and a negative end 704. The spark rod 706 is insulated to carry electricity through electrical wires. Both ends, 702 and 704, are connected to a power supply, such as, battery. The spark rod 706 has a space 708 to screw on a spark tip. A spark tip can be screwed on to the space 708 so that a sparking means becomes functional. The spark rod 706 can be screwed on to the space as shown in 214 (FIG. 2). After the spark rod is screwed in, a spark tip can be screwed in to the space 708 in a manner that the spark tip has an access to a firehead. The spark tip ignites a combustion. The spark rod and the spark tip, each, comprises two insulated wires (a positive wire and a negative wire) that carry electricity from a battery to the spark tip for creating a spark. A wire 710 carries positive-charge electricity and a wire 712 carries negative-charge electricity.

Figure 8:
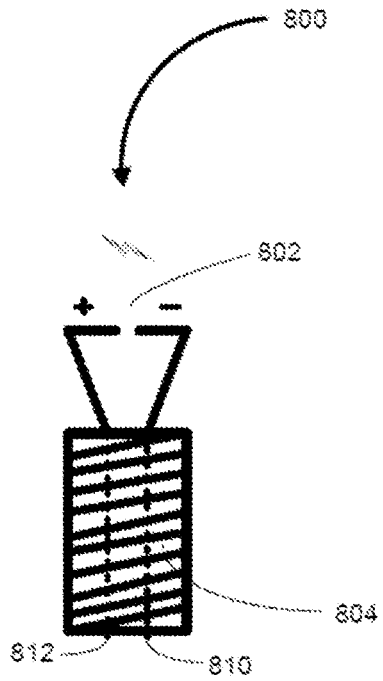
FIG. 8 is an embodiment of the engine of FIG. 1 showing an electric spark (spark tip).

FIG. 8 is an embodiment 800 showing a spark tip that screws on to a spark rod. A spark tip is screwed on to a spark rod at 708 by utilizing threads 804. A positively charged wire and a negatively charged wire create a spark at 802 where the positively charged wire and the negatively charged wire meet together. Electricity is passed through the spark rod to the spark tip by using insulated wires: a positive wire 812 and a negative wire 810.

Figure 9:
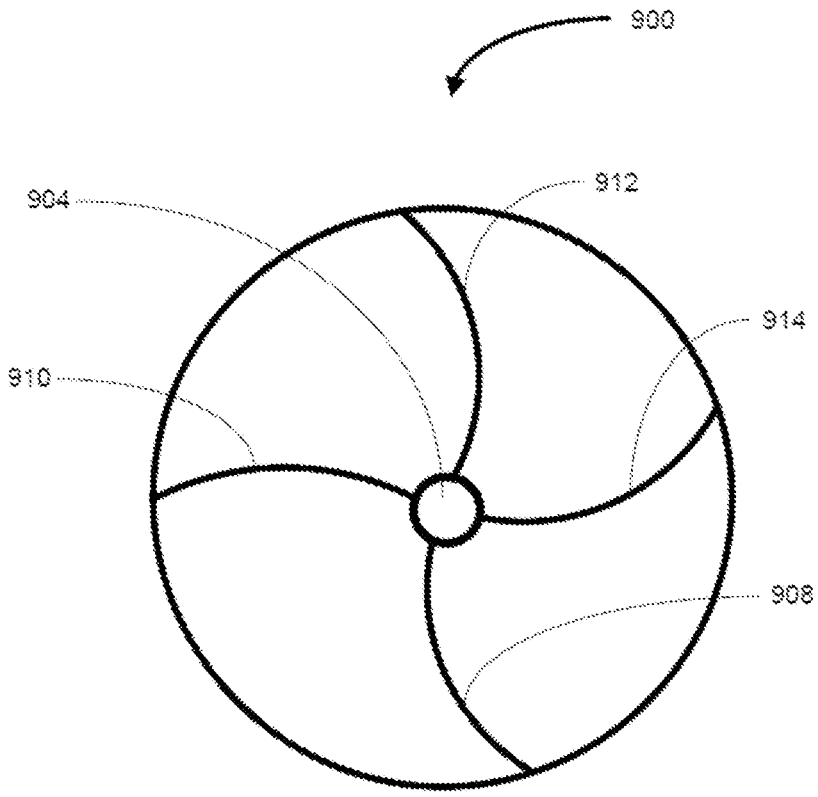
FIG. 9 is an embodiment of the engine of FIG. 1 showing an exhaust eliminator (fan).

FIG. 9 is an embodiment 900 of an exhaust eliminator. An exhaust eliminator comprises fans or fan blades. In one embodiment, fan blades may be removable. A plurality of fan blades 908, 910, 912 and 914 rotate and suck exhaust gas (compressed fuel and air mixture after being ignited creates pressurized gas) from the internal combustion area of the engine of the present invention. Exhaust gas is then removed from the engine casing. A threaded screw-on hole 904 provides a space to attach the exhaust eliminator to a crankshaft half. In one embodiment, an exhaust eliminator is screwed onto a rear crankshaft half and locked in a place so that the crankshaft half and the fans of the exhaust eliminator move with 1:1 ratio.

Figure 10:
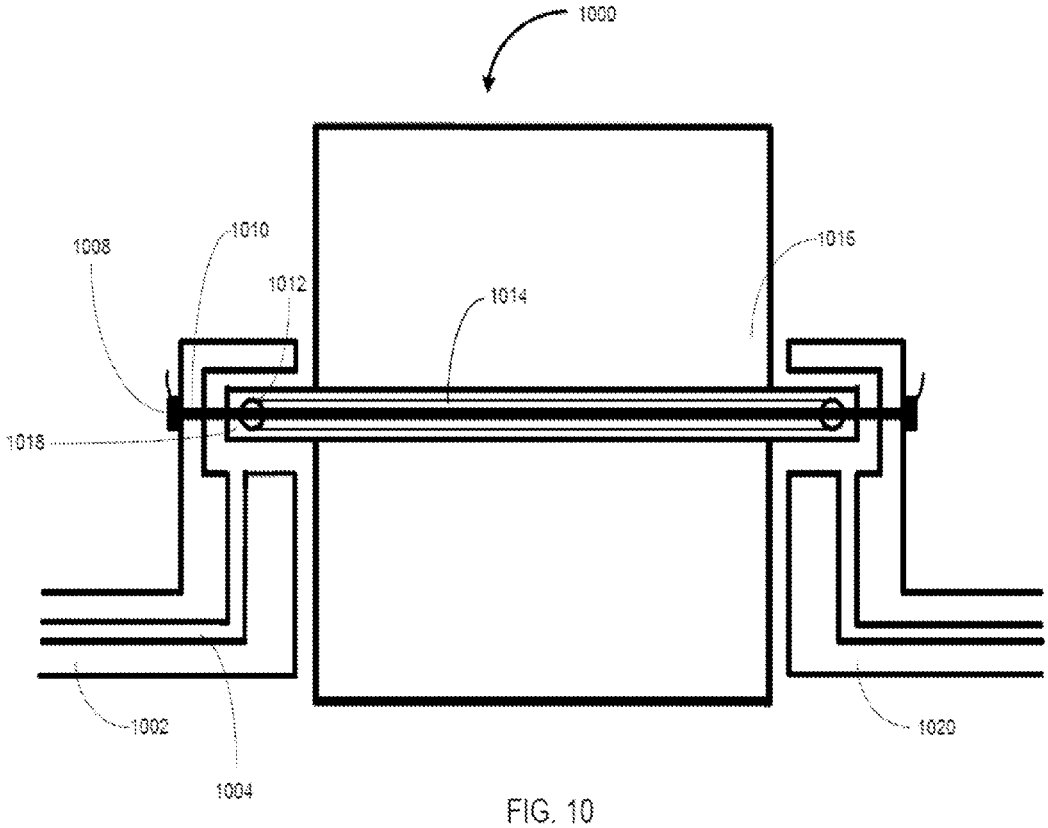
FIG. 10 is an embodiment of the engine of FIG. 1 showing a rolling pin configuration between a rotor and two crankshaft halves (front and rear).

FIG. 10 is an embodiment 1000 of a rolling pin configuration between a rotor 1016 and two crankshaft halves: a left crankshaft half 1002 and a right crankshaft half 1020. The rotor 1016 is a side-view of the rotor 220. There is an oil transfer passage 1004 that runs along the both crankshaft halves (1002 and 1020) and the rotor 1016. The oil transfer passage 1004 is continuous with the oil passage of the adjustable bearing module (as shown in the embodiment 600). The locking device 1008 uses a locking rod 1010 to hold together the two crankshaft halves (1002 and 1020) and the rotor 1016. There is a rotor pin hole 1012 that provides an oil passage between the crankshaft halves (1002 and 1020) and the rotor 1016. In the rotor 1016, there is a common passage 1014 for both oil and the locking rod: an oil transfer passage and a locking rod passage. A rolling pin configuration is achieved by the two rolling pins that extend both ways from the rotor 1016 and combine with the left crankshaft half 1002 and the right crankshaft half 1020. The left-side rolling pin 1018 comprises a rotor pin hole 1012. There is an identical right-side rolling pin with a rotor pin hole that combines with the right crankshaft half 1020. In the engine of the present invention, a rolling pin configuration transfers rotational energy (power) from the rotor 1016 to a transmission and a pulley/belt system by using two crankshaft halves (1002 and 1020). In a rolling pin configuration, two rolling pins are capable of rotating clockwise and reverse-clockwise, thereby turning crankshaft halves.

Figure 11:
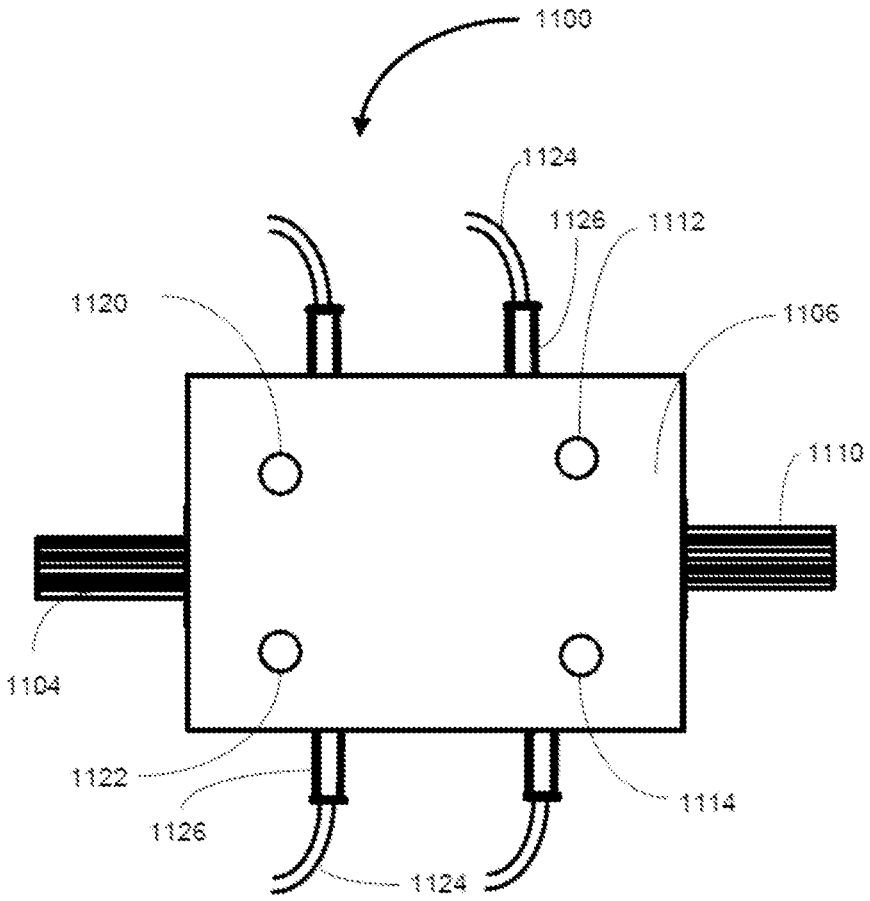
FIG. 11 is an embodiment of the engine of FIG. 1 showing an external view of the engine casing of the present invention.

FIG. 11 is an embodiment 1100 showing an external view of the engine of the present invention, that comprises an external engine casing 1106, two crankshaft halves (1104 and 1110), a plurality of exhaust passages (1112 and 1114), and a plurality of oil transfer passages (inlet and outlet) comprising an oil tubing 1124 and an oil fitting 1126. There is an inlet 1120 and an outlet 1122 for coolant.

Figure 12:
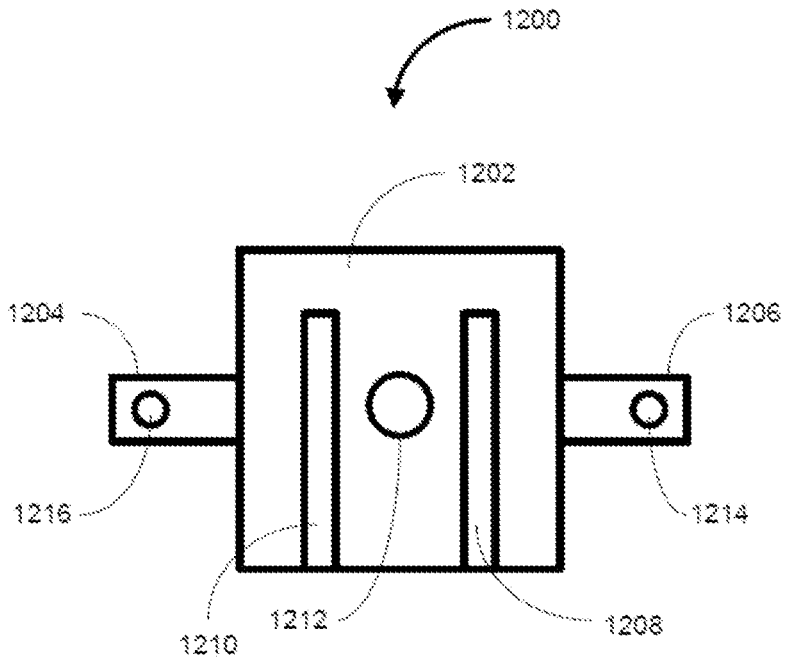
FIG. 12 is an embodiment of the engine of FIG. 1 showing a side-view (flat surface) of a multi-angular rotor.

FIG. 12 is an embodiment 1200 showing a side view (flat surface) of the multi-angular rotor with rolling pins. The flat surface 1202 of the rotor comes parallel to a firehead at a top dead center position (optimal position) for combustion. As shown in the embodiment 1000, after a combustion, the rotor 1016 rotates and turns the crankshaft halves, 1002 and 1020. In the embodiment 1200, the rotor has two rolling pins, 1204 and 1206. Each pin has a pin hole, 1216 or 1214. A person of ordinary skill in the art may design surface holes, trenches and voids (such as, 1210, 1212 and 1208; also called compression bumps and thrust grooves) on the flat area 1202 of the rotor to optimize air compression and gas thrust at the time of combustion. The embodiment 1200 is a two-dimensional view of a three-dimensional rotor. The triangular rotor in the exemplary embodiment 1200 is a triangular cube having 5 sides, out of which 3 sides (slopes) face fireheads, and 2 sides connect to the crankshaft halves using the rolling pins 1204 and 1206. A multi-angular rotor and a relevant rotor guide to accommodate a rotor can be designed by a person of ordinary skill in the art to achieve similar functionalities of the present invention. A definitive or fixed geometrical shape of a rotor and of a rotor guide does not restrict the enablement of the inventive concept of the present invention.

Figure 13:
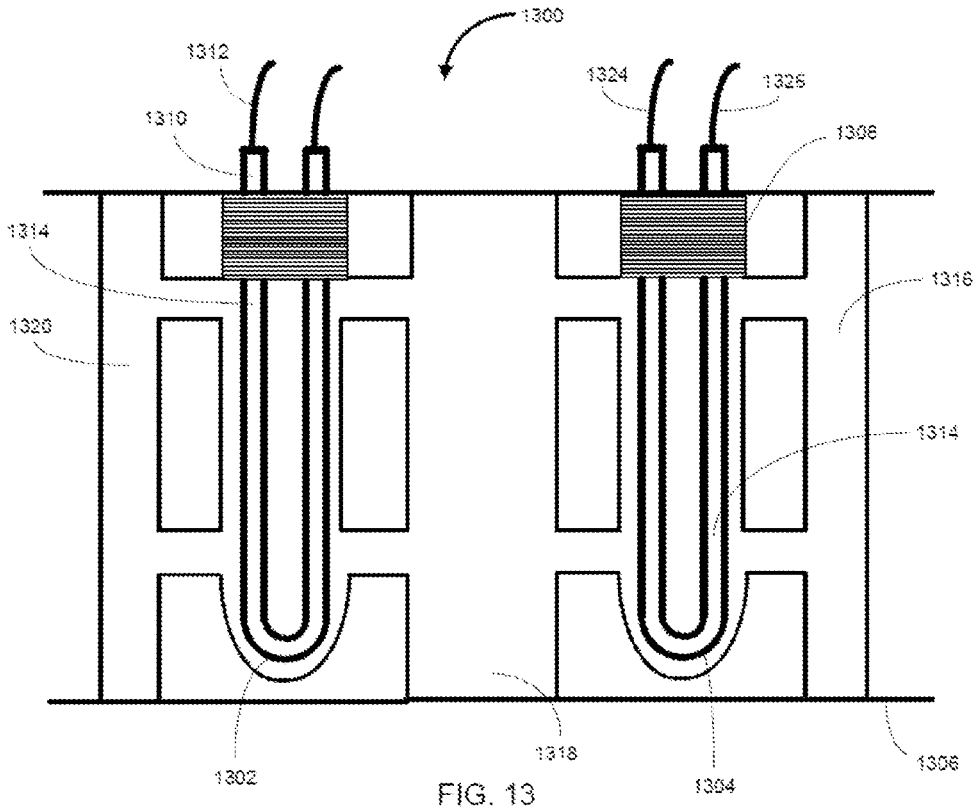
FIG. 13 is an embodiment of the engine of FIG. 1 showing a plurality of air conditioning (AC) modules and a plurality of coolant jackets in the engine casing of the present invention.

FIG. 13 is an embodiment 1300 showing a plurality of air conditioning (AC) modules, 1302 and 1304. AC modules are used optionally, in addition to coolant (at coolant jackets) in an engine casing, to improve the process of heat elimination from the casing. An AC module 1304 is screwed on to a hole 1308 of an engine casing 1306. A screw-on AC module may be screwed into the hole 1308. The hole 1308 may be threaded. An AC module has an inlet 1324 and an outlet 1326 for air conditioning (AC) fluid to pass. An inlet or outlet comprises an oil fitting and an oil tubing. An oil fitting 1310 along with an oil tubing 1312 transfers AC fluid to the AC module 1302 from an AC condenser. An AC condenser of an automobile air conditioner may be used for the application discussed herein. An AC module has a pipe 1314 that connects an inlet 1324 to an outlet 1326. Alternatively, coils may be used in place of a pipe. AC fluid passing through a pipe or coils transfers heat out from the engine casing 1306. The engine casing 1306 has a plurality of coolant jackets (1316, 1318, 1320). A combination of coolant jackets and AC modules operate to maintain the temperature of the engine casing 1306.

Reference in this specification to "one embodiment" or "an embodiment" means that a particular feature, structure, or characteristic described in connection with the embodiment is included in at least one embodiment of the invention. The appearance of the phrases "in one embodiment" or "an embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

Although the written description contains many specifics for the purposes of illustration, anyone skilled in the art will appreciate that many variations and/or alterations to the details are within the scope of the present invention. Similarly, although many of the features of the present invention are described in terms of each other, or in conjunction with each other, one skilled in the art will appreciate that many of these features can be practiced independently of other features. Accordingly, the description of the invention is set forth without any loss of generality to, and without imposing limitations upon, the invention.

Although the present invention has been described with reference to specific exemplary embodiments, it will be evident that various modification and changes can be made to these embodiments without departing from the broader spirit of the invention. Accordingly, the specification and drawings are to be regarded in an illustrative sense rather than in a restrictive sense.

What is claimed is:

1. An oil-less engine, comprising:

an engine casing with a front cover and a rear cover;

a plurality of fireheads circumferentially positioned on the inside wall of said casing;

a multi-angular rotor having multiple sides and positioned in said casing, wherein said rotor revolves around an offset axis, and, at least one side of said rotor faces a firehead selected from said plurality of fireheads;

a means for circularly guiding said rotor to a top-dead-center position of a firehead selected from said plurality of fireheads, wherein each side of said rotor at revolution achieves a top-dead-center position with a respective firehead for a combustion; and a means for transferring rotational energy generated by said rotor to a transmission, wherein said multi-angular rotor at a respective top dead center position does not make contact with said inside wall of said casing.

* * * * *